US006044234A

United States Patent [19]

Yoshizawa

[11] Patent Number: 6,044,234

[45] Date of Patent: Mar. 28, 2000

[54] IMAGE PROCESSING APPARATUS AND METHOD FOR CONTROLLING A DETECTION TIMING OF A DENSITY SENSOR

[75] Inventor: Ryuichi Yoshizawa, Numazu, Japan

[73] Assignee: Canon Kabushiki Kaisha, Tokyo, Japan

[21] Appl. No.: 09/149,276

[22] Filed: Sep. 9, 1998

[30] Foreign Application Priority Data

Sep. 11, 1997 [JP] Japan ..... 9-247314
Nov. 11, 1997 [JP] Japan ..... 9-308641

[51] Int. Cl.[7] ..... G03G 15/00

[52] U.S. Cl. ..... 399/49; 399/43; 399/53; 399/308

[58] Field of Search ..... 399/49, 72, 43, 399/46, 51, 53, 55, 302, 308, 15, 60; 358/296, 406, 504; 324/71.1, 452

[56] References Cited

U.S. PATENT DOCUMENTS 5,652,946 7/1997 Scheuer et al. ..... 399/49
5,754,920 5/1998 Tanaka et al. ..... 399/49
5,809,365 9/1998 Yoshizawa ..... 399/49 X
5,842,080 11/1998 Ashibe et al. ..... 399/49

*Primary Examiner*—Sophia S. Chen
*Attorney, Agent, or Firm*—Fitzpatrick, Cella, Harper & Scinto

[57] ABSTRACT

In an image processing apparatus for forming a visible image by developing an electrostatic latent image formed on an image carrier, transferring the visible image onto an intermediate transfer body, and then transferring the visible image onto a recording medium, a density sensor detects a patch formed on the intermediate transfer body, and corrects the measurement timing of the density sensor on the basis of the detected position of the patch. The density sensor then detects the density of a toner image for density correction to execute density control. With this control, density control can be done after any mechanical error between the intermediate transfer body and density sensor is corrected, thus improving the density control precision.

31 Claims, 12 Drawing Sheets

IMAGE PROCESSING APPARATUS AND METHOD FOR CONTROLLING A DETECTION TIMING OF A DENSITY SENSOR

BACKGROUND OF THE INVENTION

This invention relates to an image processing apparatus and method and, more particularly, to an image processing apparatus and method for forming an image by multiple transfer using electrophotography.

Conventionally, an image forming apparatus for forming a color image by so-called electrophotography in which one of a plurality of developers supported by a rotary support member is selected by rotating them, and a latent image formed on an intermediate transfer body is developed using the selected developer is popularly used. In such image processing apparatus having an intermediate transfer body, when the surface of the intermediate transfer body is contaminated under various conditions such as the use environment, the number of prints, and the like, the density of the image formed varies, and an accurate color tone cannot be obtained.

In the conventional image processing apparatus, when the image formation environment has changed, e.g., upon power ON, exchange of a photosensitive drum, exchange of a developer, after printing a predetermined number of sheets, and so forth, density control in image formation is made to obtain an accurate color tone of a color image.

As an example of density control, a toner test image for each color density detection is formed on the intermediate transfer body, and its density is automatically detected in the apparatus. The detection result is fed back to image forming conditions such as the exposure amount, developing bias, and the like to perform density control of each color, thus allowing image formation with a stable color tone. In the density control of the conventional image processing apparatus, the formation position of the toner test image formed on the intermediate transfer body surface, the density detection timing of the toner image formed on the intermediate transfer body, and the like are controlled with reference to a detection signal obtained by an image formation start position detection sensor (to be referred to as a "TOP sensor" hereinafter) placed around the intermediate transfer body.

However, in the conventional image processing apparatus, the intermediate transfer body and a density sensor for detecting the density of a toner image formed on the intermediate transfer body are not integrated. Furthermore, since mechanical precision drops due to vibrations produced by rotation of the intermediate transfer body, it is hard to detect the toner image formed on the intermediate transfer body surface by the density sensor at an accurate timing.

SUMMARY OF THE INVENTION

Accordingly, it is an object of the present invention to provide an image processing apparatus and method, which perform density correction by appropriately correcting any mechanical precision error of a density sensor for detecting the image density on an intermediate transfer body, and always allow image formation with a stable color tone.

According to the present invention, the foregoing object is attained by providing an image processing apparatus comprising an image processing apparatus for forming a visible image by developing an electrostatic latent image formed on an image carrier, transferring the visible image onto an intermediate transfer body, and then transferring the visible image onto a recording medium, comprising density detection means for detecting a reflection density of a surface of the intermediate transfer body, density control means for controlling an image forming condition on the basis of a detection result of the density detection means, and timing control means for controlling a detection timing of the density detection means.

With this arrangement, a positional deviation between the intermediate transfer body and density sensor due to vibrations produced upon rotation of the intermediate transfer body is detected, and the degree of deviation is fed back to the measurement timing of the background and the toner image formed on the surface of the intermediate transfer body upon density control, thus improving the density control precision.

And it is another object of the present invention to provide an image processing apparatus and method, which can easily detect the position of a correction patch used for detecting the mechanical precision error.

According to the present invention, the foregoing object is attained by providing an image processing apparatus comprising the density detection means measures the reflection density based on light irradiated onto and reflected by the test image, and a size of the test image in an operation direction of the intermediate transfer body is not more than a diameter of a beam spot irradiated by the density detection means.

With this arrangement, the precision and processing speed of the density control can be improved.

And it is another object of the present invention to provide an image processing apparatus and method, which can attain appropriate density control even when a correction patch used for detecting the mechanical precision error cannot be appropriately generated.

According to the present invention, the foregoing object is attained by providing an image processing apparatus comprising an image processing apparatus for forming a visible image by developing an electrostatic latent image formed on an image carrier, transferring the visible image onto an intermediate transfer body, and then transferring the visible image onto a recording medium, comprising density detection means for forming a test image on the intermediate transfer body and detecting a reflection density of the test image, density control means for controlling an image forming condition on the basis of a detection result of the density detection means, timing control means for controlling a detection timing of the density detection means, and holding means for holding timing control information in the timing control means, wherein when the reflection density of the intermediate transfer body detected by the density detection means is less than a predetermined value, the timing control means controls the detection timing of the density detection means on the basis of the timing control information held in the holding means.

With this arrangement, stable density control is always assured.

The invention is particularly advantageous since the density control is done by appropriately correcting any mechanical precision error in the density sensor for detecting the image density on the intermediate transfer body, and image formation with a stable color tone is always assured.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Preferred embodiments of the present invention will now be described in detail in accordance with the accompanying drawings.

<First Embodiment>

The overall arrangement of a laser beam printer as a multi-color image forming apparatus of this embodiment will be briefly explained below with reference to FIG. 1.

Figure 1:
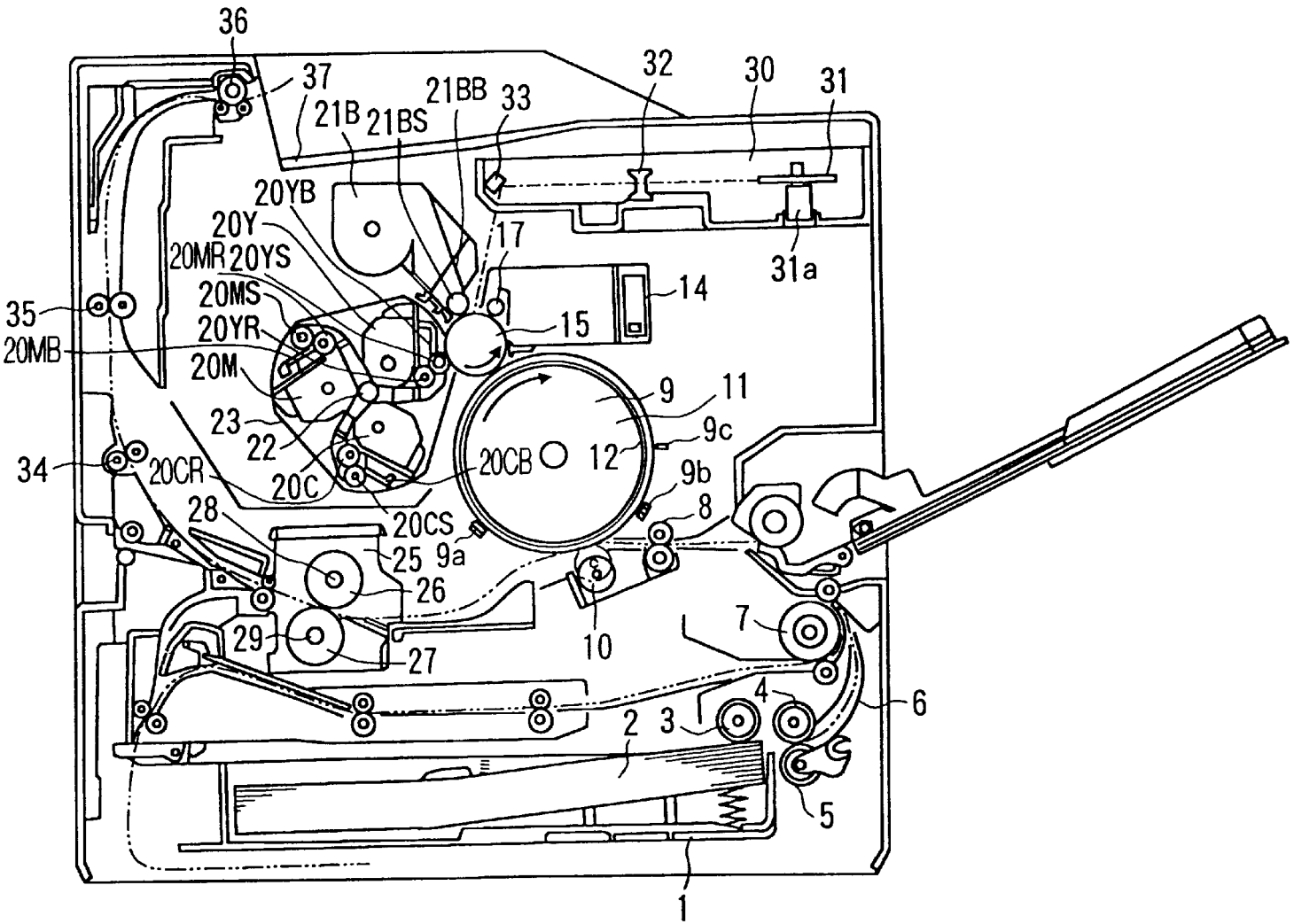
FIG. 1 is a sectional view showing the overall arrangement of a laser printer according to the first embodiment of the present invention.

As shown in FIG. 1, a laser beam printer of this embodiment forms an electrostatic latent image on a photosensitive drum 15 on the basis of image light formed based on an image signal obtained by scanning an original image by a scanner unit 30 in an image forming unit. A visible image obtained by developing the electrostatic latent image is multiple-transferred onto an intermediate transfer drum 9 to form a color visible image. The color visible image is transferred onto a transfer medium 2, and is fixed, thus forming an image on the transfer medium 2. The image forming unit of this embodiment is comprised of a photosensitive body unit (photosensitive drum 15), primary charger means (contact charger roller 17), cleaning means, developing means, intermediate transfer means (intermediate transfer drum 9), paper feed means, transfer means, fixing means, and the like. The arrangements of the respective units will be described in detail below.

The drum unit 13 integrates the photosensitive drum (photosensitive body) 15 and a cleaner container 14 of the cleaning means, which also serves as a holder of the photosensitive drum 15. The drum unit 13 is detachably supported by a printer main body, and can be easily exchanged if the service life of the photosensitive drum 15 expires. The photosensitive drum 15 is prepared by forming an organic photoconductor layer on the outer surface of an aluminum cylinder, and is rotatably supported by the cleaner container 14. The photosensitive drum 15 is rotated by a driving force transmitted from a driving motor (not shown), which rotates the photosensitive drum 15 counterclockwise in correspondence with image formation.

The contact charger roller 17 is in press contact with the surface of the photosensitive drum 15 at a predetermined pressure, and is driven upon rotation of the photosensitive drum 15. A power supply (not shown) supplies a predetermined charging bias to the contact charger roller 17 to charge the photosensitive drum 15 to a predetermined polarity and potential.

The scanner unit 30 comprises a laser diode (not shown), polygonal mirror 31, imaging lens system 32, and reflection mirror 33. Upon reception of an image signal, the laser diode emits image light corresponding to the image signal toward the polygonal mirror 31. The polygonal mirror 31 is rotated at high speed by a drive motor 31*a*, and the image light reflected by the polygonal mirror 31 selectively exposes the surface of the photosensitive drum 15, which is rotated at constant speed, via the imaging lens system 32 and reflection mirror 33, thereby forming an electrostatic latent image on the surface of the photosensitive drum 15. The developing means comprises three color developers 20Y, 20M, and 20C for developing yellow (Y), magenta (M), and cyan (C) images, and a single black developer 21B for developing a black (B) image. The three color developers 20Y, 20M, and 20C, and the black developer 21B respectively comprise sleeves 20YS, 20MS, 20CS, and 21BS, and coating blades 20YB, 20MB, 20CB, and 21BB which are in press contact with the outer surfaces of these sleeves 20YS, 20MS, 20CS, and 21BS. Also, the three color developers 20Y, 20M, and 20C respectively comprise coating rollers 20YR, 20MR, and 20CR.

The black developer 21B is detachable from the printer main body, and the color developers 20Y, 20M, and 20C are detachably attached to a developing rotary 23 which rotates about a rotation shaft 22.

The sleeve 21BS of the black developer 21B is set to have a small spacing of around 300 $\mu$m from the photosensitive drum 15. The black developer 21B conveys toner by an internal feed member, and gives a charge to toner by triboelectrification so that the outer surface of the sleeve 21BS, which rotates clockwise, is coated with the toner by the coating blade 21B. By applying a developing bias to the sleeve 21BS, an electrostatic latent image on the photosensitive drum 15 is developed, thus forming a visible image by black toner on the photosensitive drum 15.

In image formation, the three color developers 20Y, 20M, and 20C rotate upon rotation of the developing rotary 23, and a predetermined one of the sleeves 20YS, 20MS, and 20CS faces the photosensitive drum 15 to have a small spacing of around 300 $\mu$m. In this way, a predetermined one of the color developers 20Y, 20M, and 20C stops at a developing position opposing the photosensitive drum 15, thus forming a visible image on the photosensitive drum 15.

Upon forming a color image, the developing rotary 23 rotates per revolution of the intermediate transfer drum 9, the developing processes are made in the order of the yellow developer 20Y, magenta developer 20M, cyan developer 20C, and black developer 21B, and the intermediate transfer drum 9 completes four revolutions to form visible images by yellow, magenta, cyan, and black toners. As a consequence, a full-color visible image is formed on the intermediate transfer drum 9. The intermediate transfer drum 9 contacts the photosensitive drum 15 and rotates upon rotation of the photosensitive drum 15. Upon forming a color image, the transfer drum 9 rotates clockwise to receive four visible images multiple-transferred from the photosensitive drum 15. Also, a transfer drum 10 (to be described later) contacts the intermediate transfer drum 9 upon image formation to clamp and convey the transfer medium 2, thus simultaneously multiple-transferring the color visible image on the intermediate transfer drum 9 onto the transfer medium 2.

Figure 2:
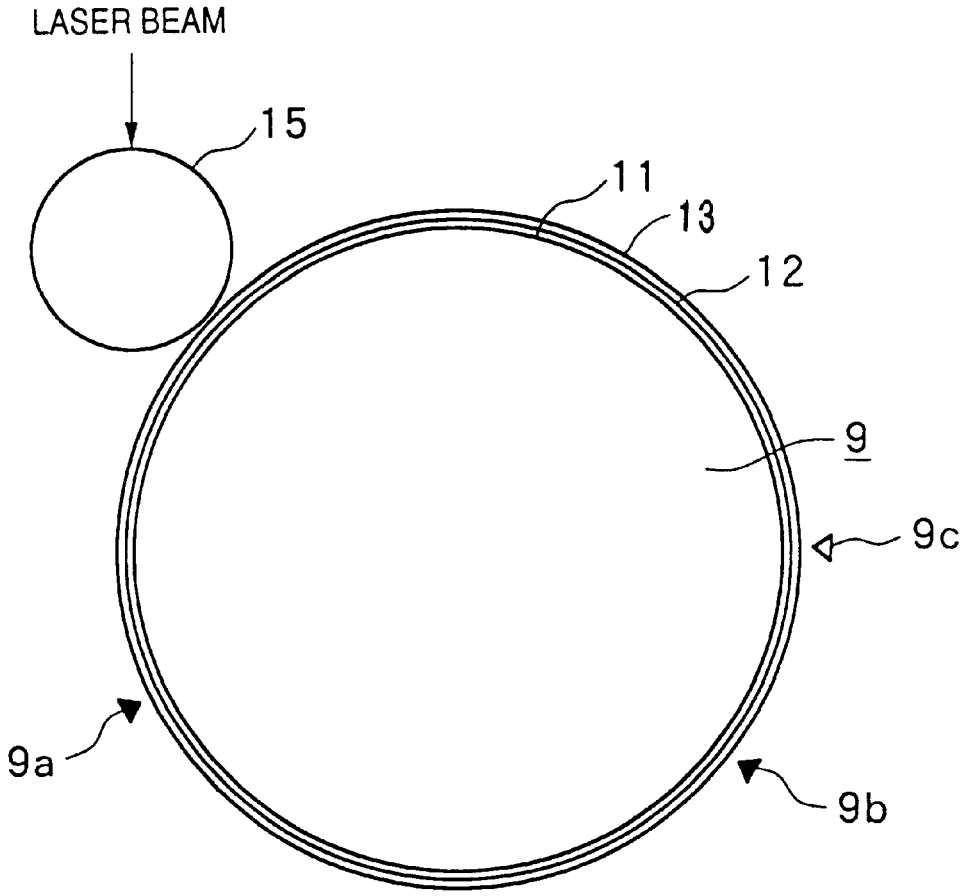
FIG. 2 is a schematic view around an intermediate transfer body in the first embodiment.

FIG. 2 is a schematic view of the intermediate transfer drum 9. As shown in FIG. 2, the intermediate transfer drum 9 is prepared by forming an elastic layer 12 on the outer surface of an aluminum cylinder 11, and forming a resistance layer 13 on the surface of the layer 12. The elastic layer 11 consists of a 1-mm thick middle-resistance sponge or rubber layer of, e.g., hydrin rubber or the like, and the resistance layer 13 mainly consists of a 20-$\mu$m thick urethane resin layer. The intermediate transfer drum 9 contacts the photosensitive drum 15, and rotates clockwise upon rotation of the photosensitive drum 15 in color image formation to receive four visible images multiple-transferred from the photosensitive drum 15. The transfer drum 10 is brought into contact with the intermediate transfer drum 9 upon image formation to clamp and convey the transfer medium 2, thus simultaneously multiple-transferring a color visible image formed on the intermediate transfer drum 9 onto the transfer medium 2.

An image formation start position detection sensor (to be referred to as a "TOP sensor" hereinafter) 9a, paper feed start timing sensor (to be referred to as an "RS sensor" hereinafter) 9*b*, and density sensor 9*c* are located around the intermediate transfer drum 9. The density sensor 9*c* detects the reflection density from a toner test image for each color density detection formed on the intermediate transfer drum 9 to obtain an accurate color tone. A main control CPU (to be described later) feeds back the detection result to image forming conditions such as the exposure amount, developing bias, and the like and performs density control to form an accurate color image. With this control, a stable image can be obtained. The transfer roller 10 is equipped as a transfer charger which is supported to be free to contact the photosensitive drum 15, and is prepared by winding a middle-resistance foamed elastic member around a metal shaft.

The transfer roller 10 escapes to its lower position so as not to disturb color visible images while the color visible images are multiple-transferred onto the intermediate transfer drum 9, as indicated by the solid line in FIG. 1. After the four color visible images are formed on the intermediate transfer drum 9, the transfer roller 10 is moved to its upper position indicated by the dotted line in FIG. 1 by a cam member (not shown) in synchronism with the transfer timing of the color visible image onto the transfer medium 2. In this way, the transfer roller 10 is in press contact with the intermediate transfer drum 9 via the transfer medium 2 at a predetermined pressure, and is applied with a bias voltage, thus transferring the color visible image on the intermediate transfer drum 9 onto the transfer medium 2.

A fixing unit 25 fixes the transferred color visible image while conveying the transfer medium 2, and comprises a fixing roller 26 for heating the transfer medium 2, and a press roller 27 for pressing the transfer medium 2 against the fixing roller 26, as shown in FIG. 1. The fixing roller 26 and press roller 27 are formed into a hollow shape, and respectively incorporate heaters 28 and 29. That is, the transfer medium 2 that carries the color visible image is conveyed by the fixing roller 26 and press roller 27 to receive heat and pressure, thus fixing the toner image on its surface.

After the visible image is fixed, the transfer medium is exhausted to an exhaust tray 37 via exhaust rollers 34, 35, and 36, thus ending image formation.

The cleaning means cleans any residual toner on the photosensitive drum 15 and intermediate transfer drum 9. Waste toner after a visible image formed by toner on the photosensitive drum has been transferred onto the intermediate transfer drum 9 or after a four-color visible image formed on the intermediate transfer drum 9 has been transferred onto the transfer medium 2 is stored in the cleaner container.

Image formation in the laser beam printer shown in FIG. 1 will be explained below. Upon image formation, the photosensitive drum 15 is rotated by a drive means (not shown) at a predetermined process speed, and is charged to a predetermined polarity and potential by the contact charger roller 17 applied with a predetermined charging bias. An image exposure laser beam is irradiated onto the charged photosensitive drum 15 by the scanner unit 30 to form an electrostatic latent image corresponding to the first color component (e.g., yellow) of an objective color image. Subsequently, the electrostatic latent image is developed by yellow toner by the Y developer 20Y.

The yellow toner image formed and carried on the photosensitive drum 15 is primarily transferred onto the outer surface of the intermediate transfer drum 9 by a pressure at a transfer nip (primary transfer portion) and a primary transfer bias applied to the intermediate transfer drum 9 while it passes through the transfer nip between the photosensitive drum 15 and intermediate transfer drum 9. Similarly, magenta, cyan, and black toner images respectively formed and carried on the photosensitive drum 15 by the M, C, and BK developers 20M, 20C, and 21B are superposed and transferred onto the intermediate transfer drum 9 in turn, thus forming a full-color toner image corresponding to the objective color image.

A transfer medium 2 is fed one by one by a paper feed roller 3 from a paper feed cassette 1, and is conveyed to a transfer nip (secondary transfer portion) between the intermediate transfer drum 9 and transfer roller 10 by a pair of convey rollers 4 and 5, convey guide 6, convey roller 7, registration rollers 8, and the like. In this case, a secondary transfer bias is applied to the transfer roller 10 to transfer the full-color toner image from the intermediate transfer drum 9 onto the transfer medium 2.

The transfer medium 2 onto which the full-color toner image has been transferred is conveyed to the fixing unit 25, and a color visible image is permanently fixed onto the transfer medium 2 by heating and pressing by the fixing roller 26 and press roller 27. The transfer medium 2 is exhausted onto the exhaust tray 37 via the exhaust rollers 34, 35, and 36.

Figure 3:
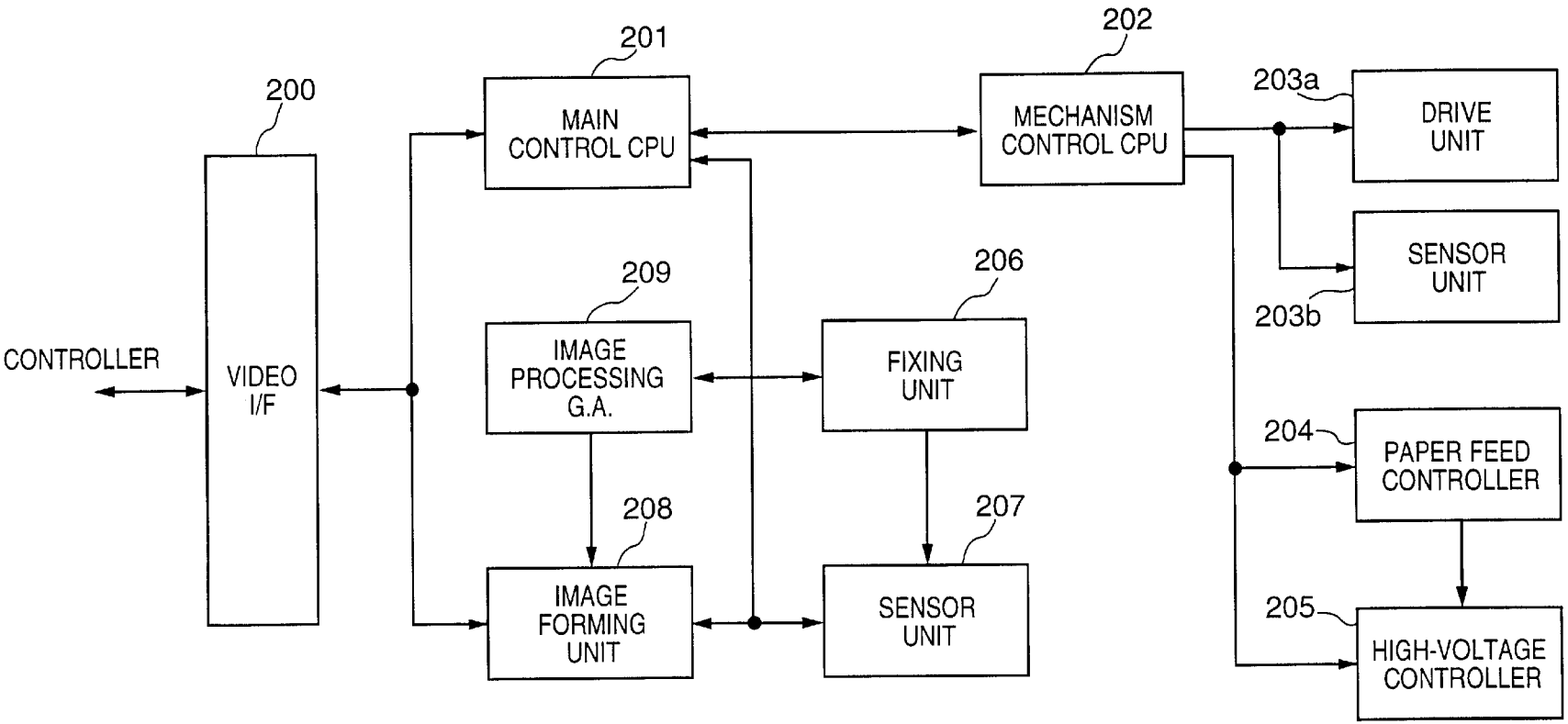
FIG. 3 is a block diagram showing the schematic arrangement of an engine unit in the first embodiment.

After the above-mentioned image formation, the residual toner on the photosensitive drum 15 is cleaned by a cleaning member (not shown, and is stored in the cleaner container 14. Also, the residual toner on the intermediate transfer drum 9 is cleaned by a cleaning device (not shown). FIG. 3 is a block diagram showing the schematic arrangement of an engine unit of the laser beam printer of this embodiment. The engine unit has a main control unit 201 for controlling a Video I/F 200 as an interface unit with an external controller for controlling this engine, a fixing unit 206, a sensor unit 207 which includes a temperature/humidity sensor, and detects the toner remaining amount, density, and the like, an image processing G.A. 209 for performing $\gamma$ correction and the like of image data received via the I/F 200, an image forming unit 208 which includes a scanner motor and the like and outputs a laser beam, image, and the like, and a mechanism control CPU 202 as a sub CPU. Note that the mechanism control CPU 202 controls a drive unit 203*a* including a motor, clutch, fan, and the like, a sensor unit 203*b* for, e.g., position detection, a paper feed controller 204, and a high-voltage controller 205. The main control CPU 201 and mechanism control CPU 202 respectively comprise ROMs and RAMs, and execute various kinds of control using their RAMs as work areas in accordance with control programs stored in, e.g., their ROMs. Note that the TOP sensor 9*a* and RS sensor 9*b* shown in FIG. 2 correspond to the sensor unit 203*b* shown in FIG. 3, and the density sensor 9*c* corresponds to the sensor unit 207 in FIG. 3.

Common density control techniques are DMAX control and halftone control. In the DMAX control, toner test images are formed by setting the exposure amount constant and varying the developing high voltage, and the densities of those toner images are measured to calculate developing high voltage values corresponding to target densities of the respective colors. On the other hand, in the halftone control, toner test images are formed by setting the developing high voltage value calculated in the DMAX control constant, and varying the exposure amount in several steps by a controller, and the values obtained by measuring these toner images are fed back to the controller.

Figure 4:
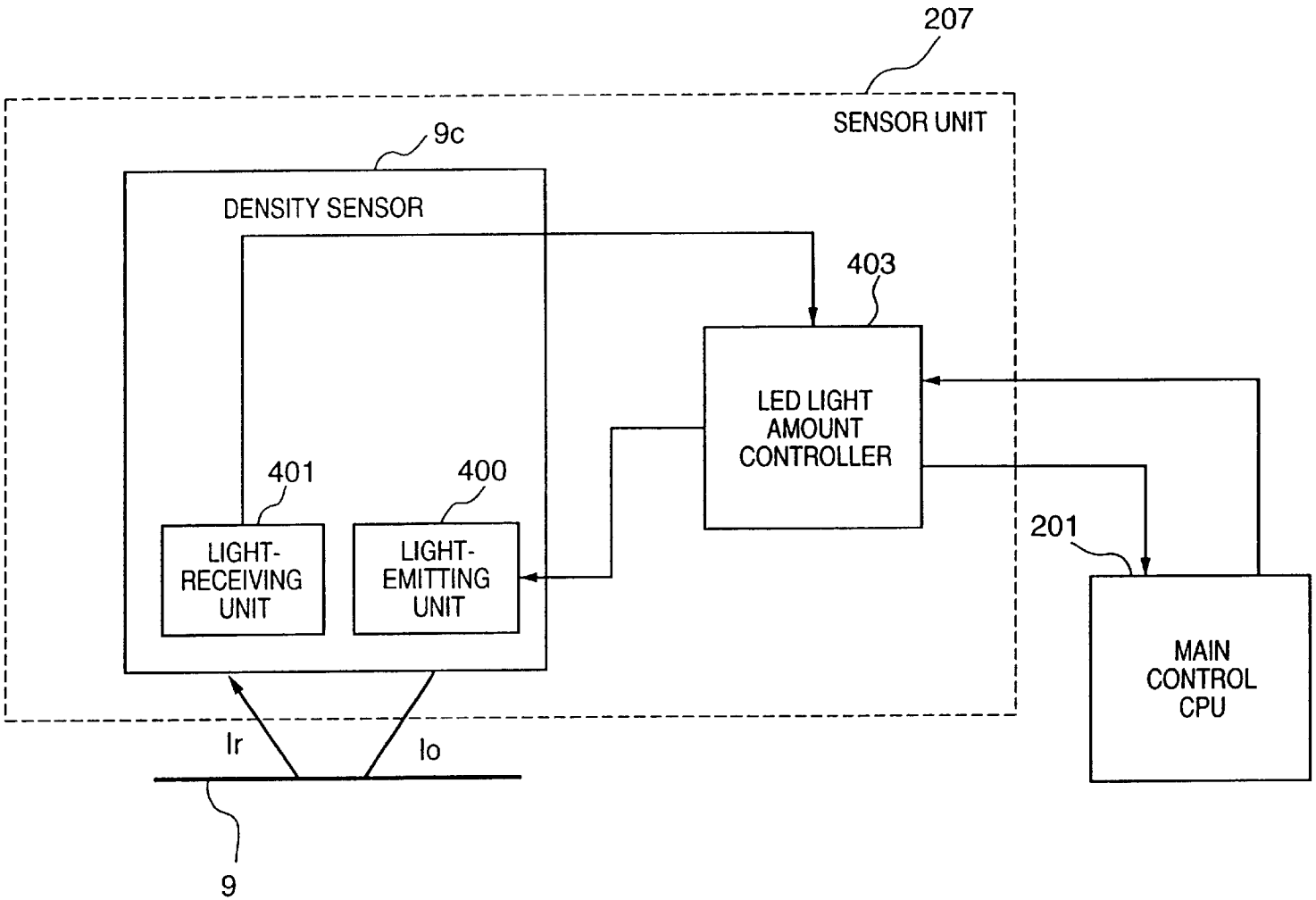
FIG. 4 is a block diagram showing image density control in the first embodiment.

FIG. 4 is a detailed block diagram showing the arrangement for realizing image density detection using the density sensor 9*c* in this embodiment. The sensor unit 207 includes the density sensor 9*c* and an LED light amount controller 403, and the density sensor 9*c* is constructed by a pair of infrared light-emitting unit 400 and infrared light-receiving unit 401 as an optical sensor. An infrared ray (to be referred to as light source light hereinafter) Io emitted by the infrared light-emitting unit 400 is reflected by the surface of the intermediate transfer drum 9, and reflected light Ir is measured by the infrared light-receiving unit 401. The reflected light measured by the infrared light-receiving unit 401 is monitored by the LED light amount controller 403, and is sent to the main control CPU 201. The main control CPU 201 performs density calculations and developing bias voltage control on the basis of the light source light Io and the measurement value of the reflected light Ir.

Figure 5:
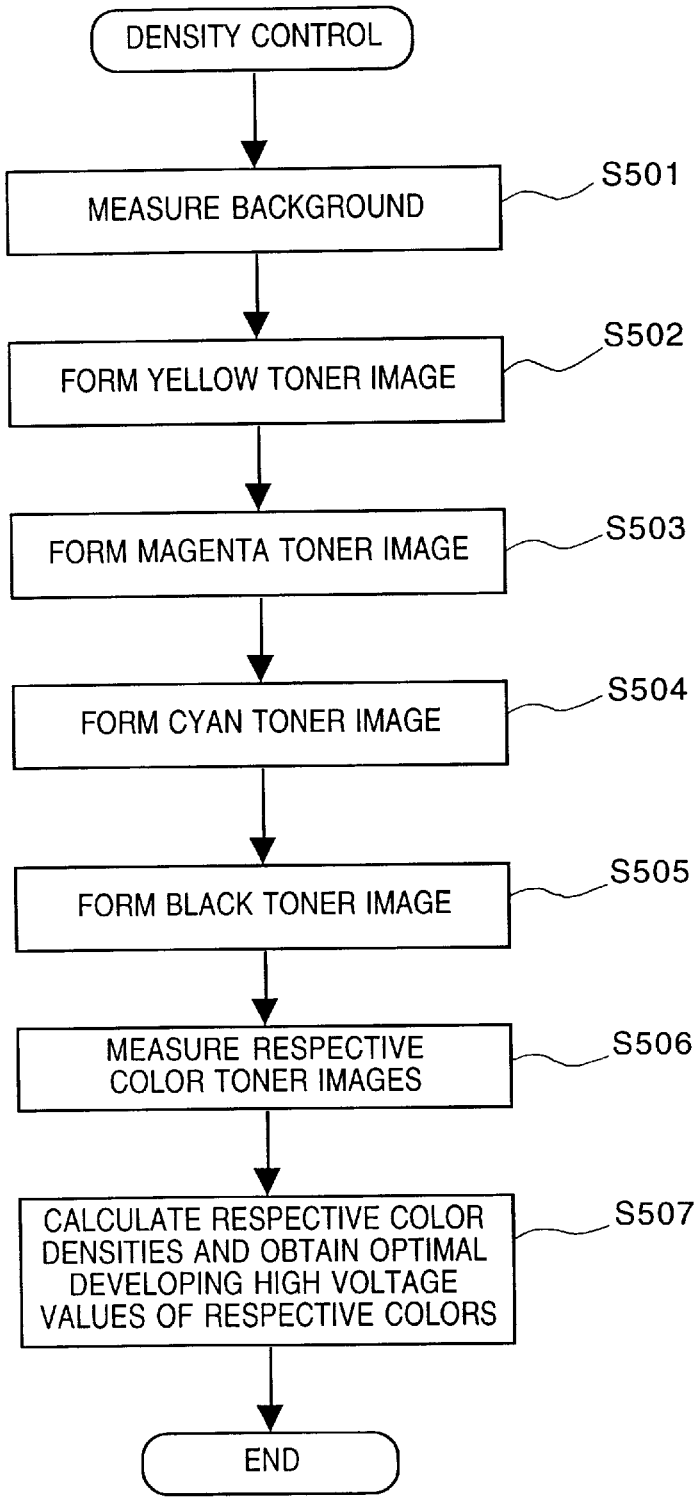
FIG. 5 is a flow chart showing the density control in the first embodiment.

FIG. 5 is a flow chart of the density control of this embodiment. The density control will be explained below. Note that the processing shown in the flow chart is executed by the main control CPU 201 in accordance with a control program.

Initially, the reflection density of the surface (to be referred to as "background" hereinafter) of the intermediate transfer drum 9 at the formation position of each toner image for color density detection is measured by the density sensor 9*c* (S501). A yellow toner image is then formed on the surface of the intermediate transfer drum 9 (S502). Subsequently, magenta, cyan, and black toner images are respectively formed at predetermined positions (S503, S504, S505). Note that the image formation order of these four color toners is not limited to the above-mentioned order, but may be arbitrarily determined.

After the color toner images are formed on the surface of the intermediate transfer drum 9, the reflection densities of the respective color toner images are measured by the density sensor 9*c* (S506). At this time, the measurement timing of each color toner image is the same as that of the background (S501).

In step S507, so-called DMAX control is executed. That is, image densities are calculated based on the background measurement value in step S501 and the measurement values of the respective toner images in step S506 to calculate developing high voltage values corresponding to the target densities of the respective colors.

In the density control, the formation positions of the respective toner images on the surface of the intermediate transfer drum 9, the measurement timings of the densities of the toner images formed on the surface of the intermediate transfer drum 9, and the like are controlled by the main control CPU 201 with reference to a detection signal from the TOP sensor 9*a* for detecting the image formation start position of the intermediate transfer drum 9.

However, as described in the paragraphs of the prior art, the density sensor 9*c* for measuring the reflection density of each color toner image formed on the surface of the intermediate transfer drum 9 is not fixed to the intermediate transfer drum 9, and a positional deviation is generated between the intermediate transfer drum 9 and density sensor 9*c* due to vibrations and the like produced upon rotation of the intermediate transfer drum 9. For this reason, it is difficult to detect the toner image formed on the surface of the intermediate transfer drum 9 at an accurate timing.

In the arrangement for forming toner images on the intermediate transfer body, since the intermediate transfer body has a small size, the size of the toner image is limited.

Especially, when a plurality of lower- to higher-density toner images are formed on the intermediate transfer body, the above-mentioned limitation becomes more stricter.

In order to form toner images with a predetermined (small) size on the small-size intermediate transfer body and to detect the formed toner images at accurate timings, higher read precision is required.

In view of this problem, according to this embodiment, a variation in relative position between the intermediate transfer drum 9 and density sensor 9*c* due to variations and the like produced upon rotation of the intermediate transfer drum 9, i.e., the positional deviation between the intermediate transfer drum 9 and density sensor 9*c*, is detected by detecting a toner image formed on the surface of the intermediate transfer drum 9 by the density sensor 9*c*. The background and toner image measurement timings are changed on the basis of the deviation amount, thus improving the density control precision.

That is, in this embodiment, prior to measurement of the background upon density control, a toner image for measurement timing correction (to be referred to as a "correction patch" hereinafter) is formed on the intermediate transfer drum 9, and is monitored to detect the deviation of the correction patch from its original position. Based on the detected deviation amount, the measurement timings of the density control are changed. Such correction will be described in detail below.

Figure 6:
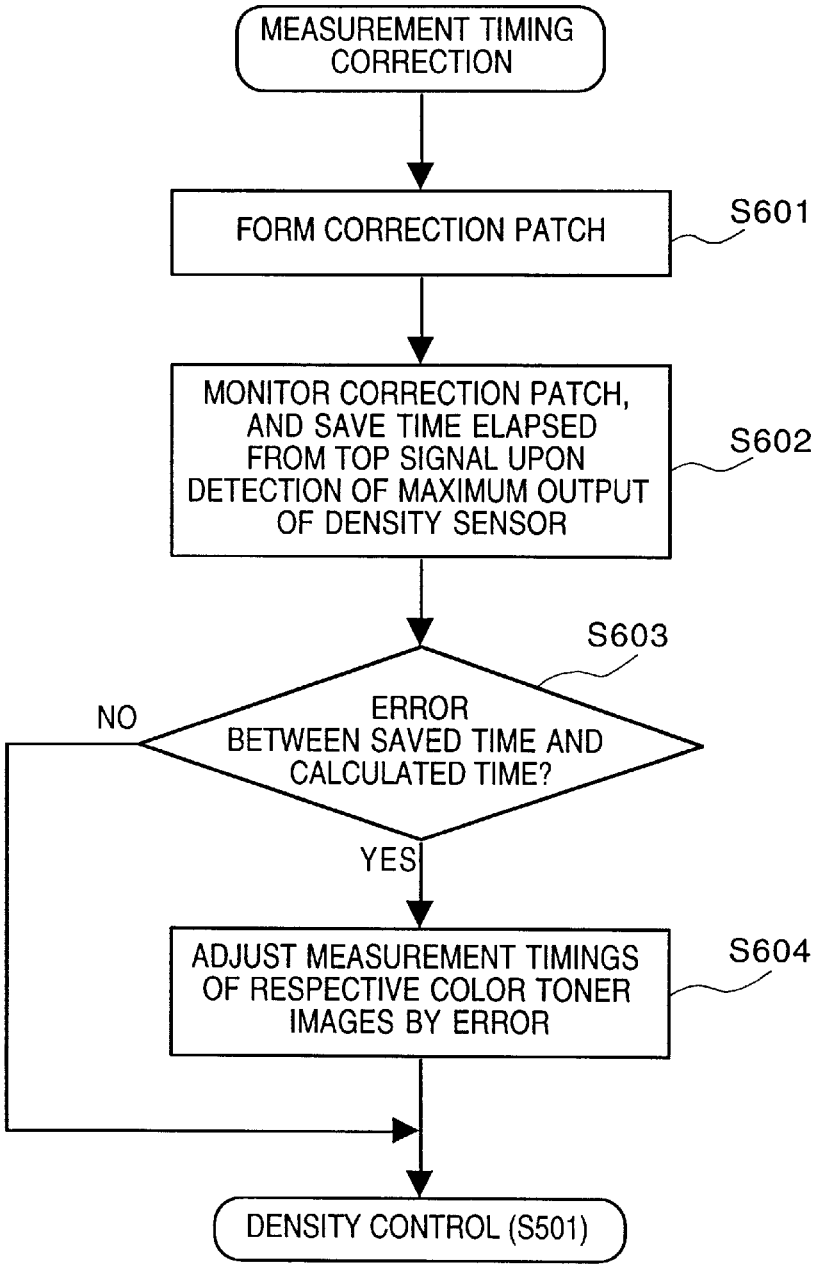
FIG. 6 is a flow chart showing measurement timing correction of the density control in the first embodiment.

FIG. 6 is a flow chart of the density control measurement timing correction in this embodiment. Note that the processing shown in the flow chart is executed by the main control CPU 201 in accordance with a control program.

Initially, a correction patch is formed on the surface of the intermediate transfer drum 9 (S601), and a predetermined range including the correction patch is monitored (scanned) by the density sensor 9*c* to save the time elapsed from the correction patch detection timing, i.e., from the detection timing of a TOP signal (image formation start position signal) by the TOP sensor 9*a* (S602).

FIGS. 7A to 8B show examples of the correction patch, and the method of monitoring the correction patch in this embodiment will be explained below.

Figure 7B:
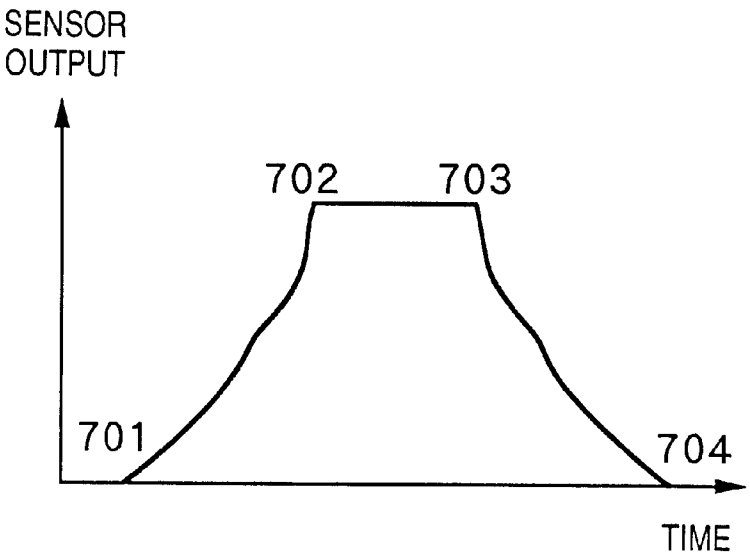
FIGS. 7A and 7B show an example of a correction patch in the first embodiment.
Figure 7A:
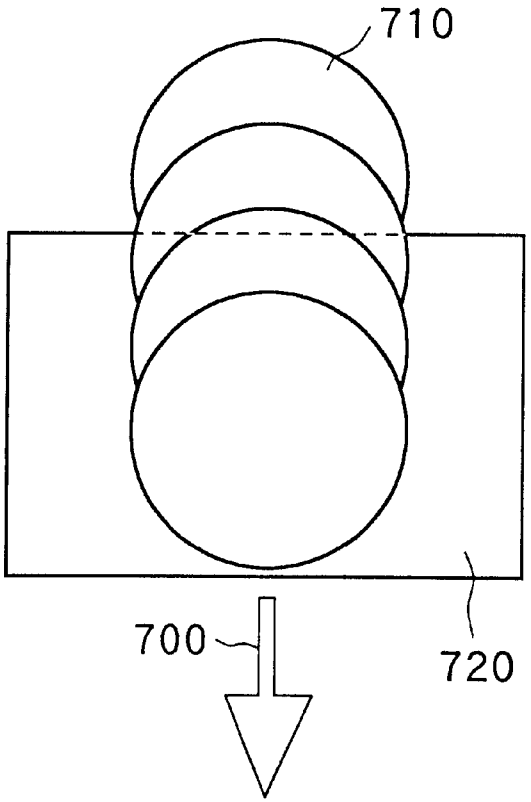

In FIG. 7A, reference numeral 720 denotes a correction patch formed on the surface of the intermediate transfer drum 9; and 710, a spot of the density sensor 9*c*. The density sensor 9*c* monitors the correction patch 720 in the direction of an arrow 700 in FIG. 7A. Note that FIG. 7B shows the output from the density sensor 9*c* when the width of the correction patch 720 in the sub-scanning direction is larger than the spot size of the density sensor 9*c*, as shown in FIG. 7A.

As shown in FIG. 7B, the output from the density sensor 9c upon monitoring the correction patch 720 in the direction of the arrow 700 gradually increases when the correction path 720 enters the spot 710 of the density sensor 9*c* (701→702). When the spot 710 falls within the correction patch 720, the output from the density sensor 9*c* reaches a flat peak before the correction path 720 exits the spot 710 (702→703). As the spot 710 gradually leaves the correction patch 720, the output decreases (703→704).

In order to determine the position of the correction patch 720 from the output of the density sensor 9*c* shown in FIG. 7B, one of the leading end of the correction patch 720 in 701→702, the center of the correction patch 720 in the sub-scanning direction in 702→703, and the trailing end of the correction patch 720 in 703→704 may be detected. However, in these cases, relatively complicated processing is required for determining the accurate position of the correction patch 720.

Figure 8B:
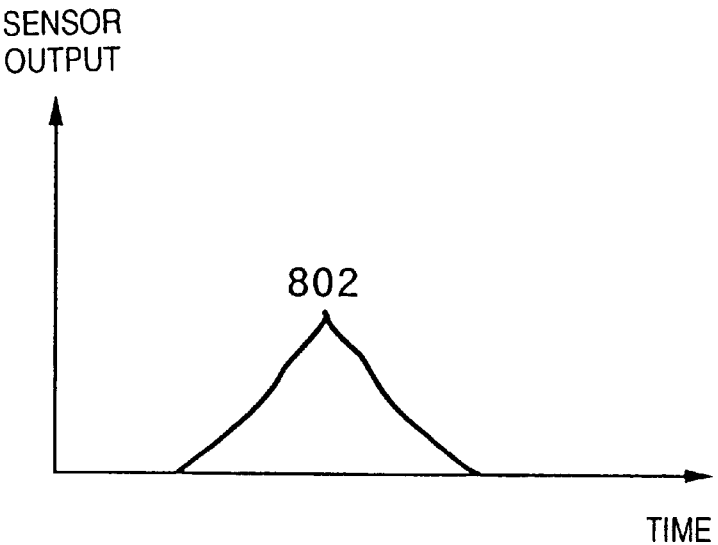
FIGS. 8A and 8B show another example of the correction patch in the first embodiment.
Figure 8A:
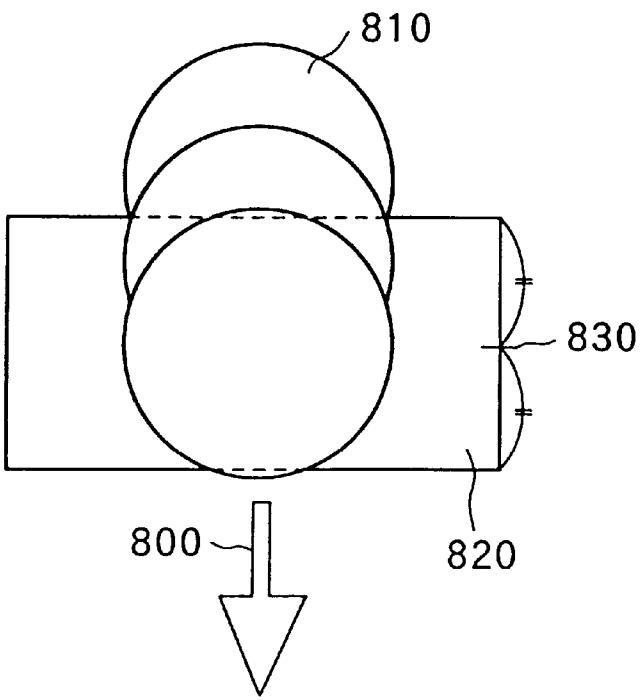

In this embodiment, in order to determine the accurate position of the correction patch 720, the width of the correction patch 720 in the sub-scanning direction is set to be equal to or smaller than the spot size of the density sensor 9*c*. FIGS. 8A and 8B show this example. In FIG. 8A, reference numeral 820 denotes a correction patch formed on the surface of the intermediate transfer drum 9; and 810, a spot of the density sensor 9*c*. The density sensor 9*c* monitors the correction patch 820 in the direction of an arrow 800 in FIG. 8A. FIG. 8B shows the output from the density sensor 9*c* when the width of the correction patch 820 in the sub-scanning direction is equal to or smaller than the spot size of the density sensor 9*c*, as shown in FIG. 8A. As shown in FIG. 8B, the output from the density sensor 9c has one and only peak (802), which corresponds to the center of the correction patch 820, indicated by 830 in FIG. 8A. Hence, the position of the correction patch 820 can be easily determined.

More specifically, in this embodiment, the correction path 820 having a width in the sub-scanning direction equal to or smaller than the spot size of the density sensor 9c is formed in step S601, and the time elapsed from the detection timing of the TOP signal upon detection of the center of the correction patch 820 is saved in step S602.

In this fashion, by comparing the calculated time elapsed from the image formation start position and the actual time elapsed from the TOP signal upon detection of the center of the correction patch, the deviation amount (to be referred to as a "mechanical precision error" hereinafter) of the relative position between the intermediate transfer drum 9 and density sensor 9*c* can be obtained.

Hence, if no mechanical precision error is found in step S603 in FIG. 6, the normal density control shown in the flow chart in FIG. 5 is started; if a mechanical precision error is found, the flow advances to step S604 to send that error to the main control CPU 201 and to adjust the background and patch measurement timings of the respective color toner images by the error.

The method of adjusting the background and patch measurement timings of the respective color toner images in this embodiment will be explained below with reference to FIG. 9.

Figure 9:
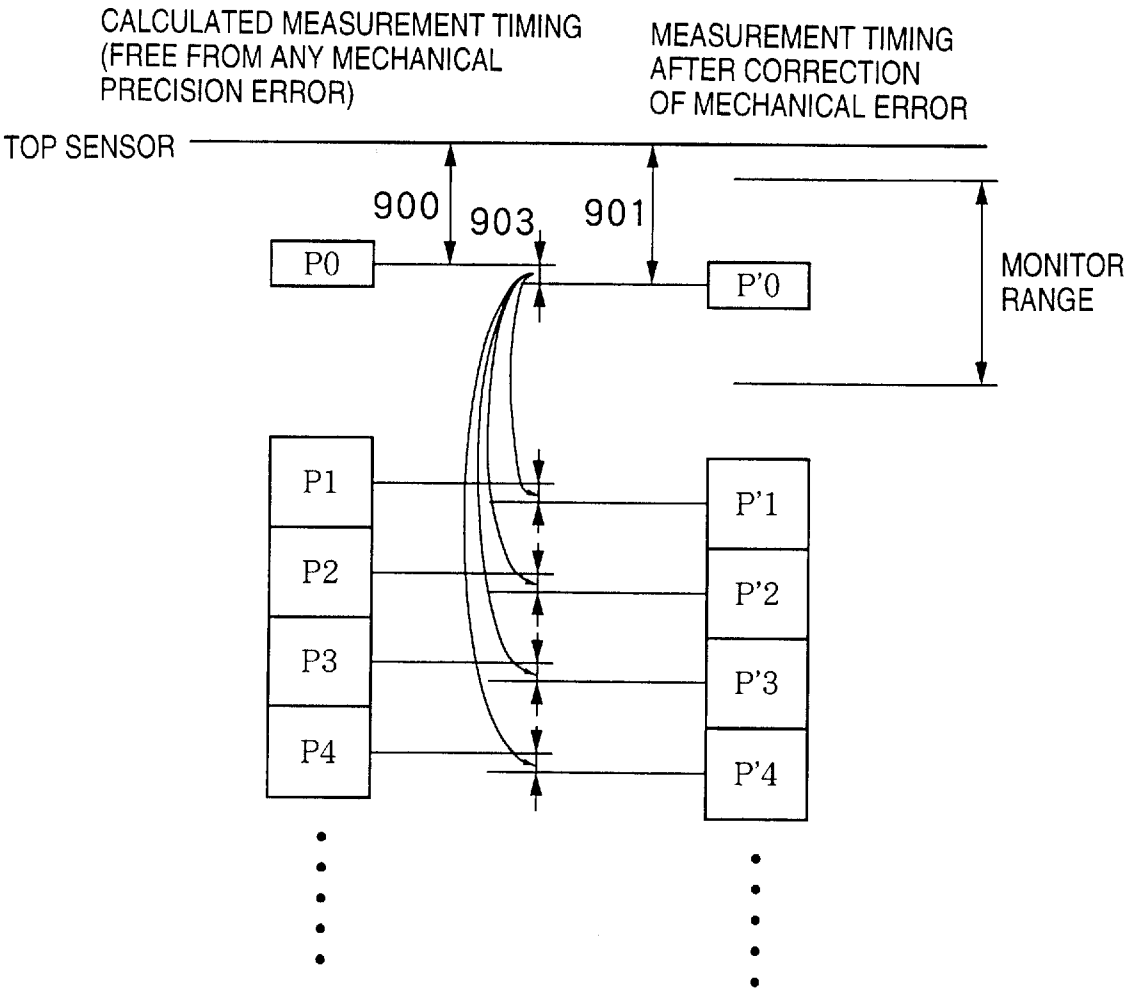
FIG. 9 shows the measurement timing correction result in the first embodiment.

FIG. 9 shows the state of the surface of the intermediate transfer drum 9 before and after the measurement timing correction. In FIG. 9, reference symbol P0 denotes a correction patch; and P1, P2, P3, P4, . . . , toner images for density control formed on the surface of the intermediate transfer drum 9. That is, the patch PO and images P1, P2, P3, P4, . . . represent the position relationship at the calculated measurement timings, i.e., from the image formation start detection position of the TOP sensor 9*a* when there is no mechanical precision error. Reference numeral 900 denotes a time elapsed from the TOP sensor 9*a* to the center of the width of the patch P0 in the sub-scanning direction. Also, reference symbols P'0, P'1, P'2, P'3, P'4, . . . respectively denote a correction path and toner images, which represent actual measurement timings when there is a mechanical precision error. Reference numeral 901 denotes an elapsed time to the center of the width of the patch P'0 in the sub-scanning direction, which is obtained by monitoring the density sensor 9*c* within a given range after the patch P'0 is formed on the surface of the intermediate transfer drum 9. Also, reference numeral 903 denotes the difference between the elapsed times 900 and 901, which difference corresponds to the error itself produced by a variation of the relative position between the intermediate transfer drum 9 and density sensor 9*c*. In this embodiment, as shown in FIG. 9, the measurement timings of the respective toner images for density control are adjusted to reflect that error. For example, the measurement timing of the toner image P1 is adjusted to P'1 by adding a difference equivalent to the difference 903 to its calculated value.

In this way, after the mechanical precision error is fed back to the control of the background and patch measurement timings of the respective toner images, the density control shown in FIG. 5 is done, thus guaranteeing accurate density control if the relative position between the intermediate transfer drum 9 and density sensor 9*c* has any mechanical precision error.

Note that a plurality of toner images with densities in ascending order are preferably formed to attain more effective density control. In this embodiment, toner images are formed in units of colors. Alternatively, a plurality of lower- to higher-density toner images may be formed in units of colors.

To restate, according to this embodiment, any mechanical precision error produced by vibrations or the like upon rotation of the intermediate transfer body is corrected, and a toner image formed on the surface of the intermediate transfer body for density control can be accurately measured, thus improving the density control precision.

Furthermore, since the width of the toner image (correction patch) for measurement timing correction in the sub-scanning direction is set to be equal to or smaller than the spot size of the density sensor 9*c*, the position of the patch can be easily detected, thus detecting any mechanical precision error more accurately, and improving the precision and processing speed of the density control.

<Second Embodiment>

The second embodiment according to the present invention will be described below. In the second embodiment, a density control method which assures more stable image formation by adopting the method of performing density control while setting the measurement timing correction patch size to be equal to or smaller than the spot size of the density sensor, described in the aforementioned first embodiment, will be described. Note that the arrangement of the laser beam printer in the second embodiment is the same as that shown in FIGS. 1 and 2 in the first embodiment, and a detailed description thereof will be omitted.

Figure 10:
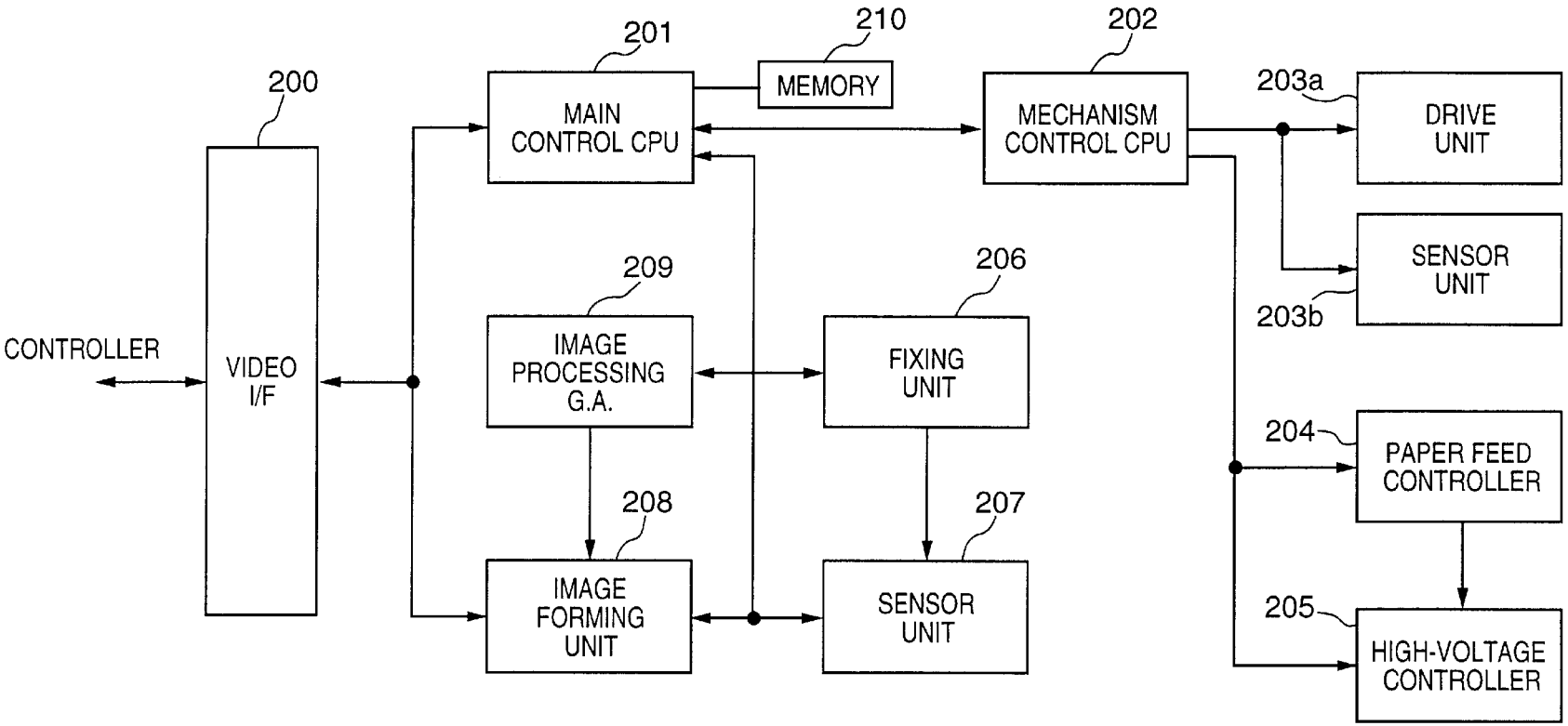
FIG. 10 is a block diagram showing the schematic arrangement of an engine unit according to the second embodiment of the present invention.

FIG. 10 is a block diagram showing the schematic arrangement of an engine unit in the laser beam printer of the second embodiment. In FIG. 10, the main control CPU 201 is characterized by having a nonvolatile memory 210. The same reference numerals in FIG. 10 denote the same parts as those in FIG. 3 in the first embodiment, and a detailed description thereof will be omitted.

In the first embodiment mentioned above, in order to correct any measurement timing error produced upon measuring the reflection density of a toner image formed on the surface of the intermediate transfer drum 9 by the density sensor 9*c*, a correction patch is formed on the intermediate transfer drum 9 immediately before execution of the density control, a given range including the correction path is scanned by the density sensor to detect the position of the correction path, and the measurement timing, i.e., mechanical precision error, is corrected based on the detected positional deviation.

However, a correction patch cannot often be appropriately formed on the intermediate transfer drum 9 for some reason, e.g., toner shortage and the like. In such case, it is very hard to detect the accurate position of the correction patch by the density sensor 9*c*. For example, when the correction patch formed does not have an appropriate density due to toner shortage, if a contamination or the like having a reflection density higher than that of the correction patch is present on the intermediate transfer drum 9, the position of that contamination may be determined as the correction patch position. In such case, of course, measurement timing correction cannot be appropriately done.

To prevent such problem, in the second embodiment, it is checked if the reflection density of the correction patch is sufficiently high. If it is determined that the correction patch has a sufficiently high reflection density, the measurement timing error calculated based on the measurement result of that correction patch is stored in the memory 210. On the other hand, if the reflection density of the correction patch is not sufficiently high, the measurement result of the correction patch is ignored, and the measurement timing correction is done based on the measurement timing error already stored in the memory 210.

Figure 11:
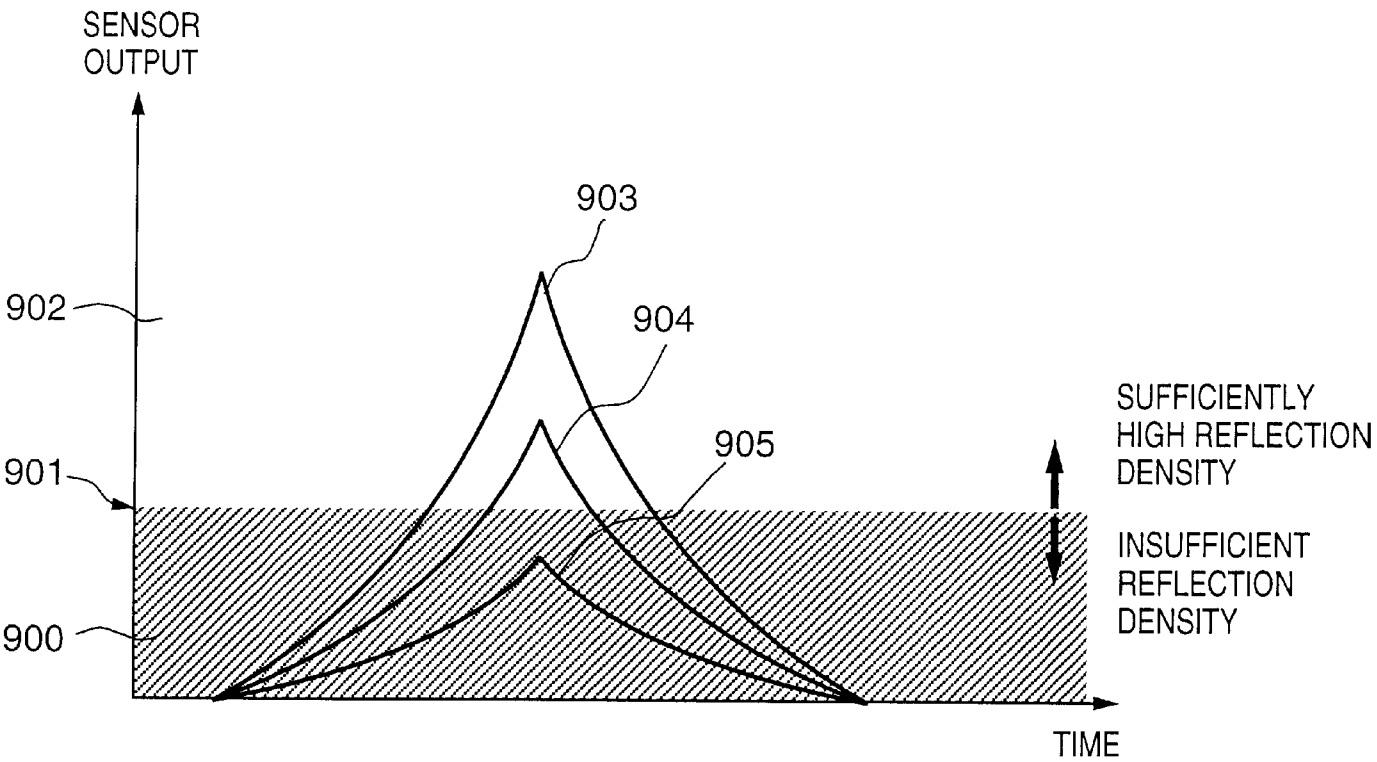
FIG. 11 is a graph showing the relationship between a plurality of correction patches corresponding to different toner amounts, and the output from a density sensor 9*c* in the second embodiment.

FIG. 11 shows the relationship between a plurality of correction patches with different toner amounts, and the outputs from the density sensor 9*c*. In the second embodiment, when the peak value of the sensor output is lower than an insufficient reflection density determination level (901 in FIG. 11), as indicated by 905 in FIG. 11, the main control CPU 201 determines that the reflection density is insufficient (a region 900 in FIG. 11). On the other hand, if the peak value of the sensor output is higher than the insufficient reflection density determination level, as indicated by 903 and 904 in FIG. 11, the CPU 201 determines that the reflection density is sufficiently high (a region 902 in FIG. 11).

Figure 12:
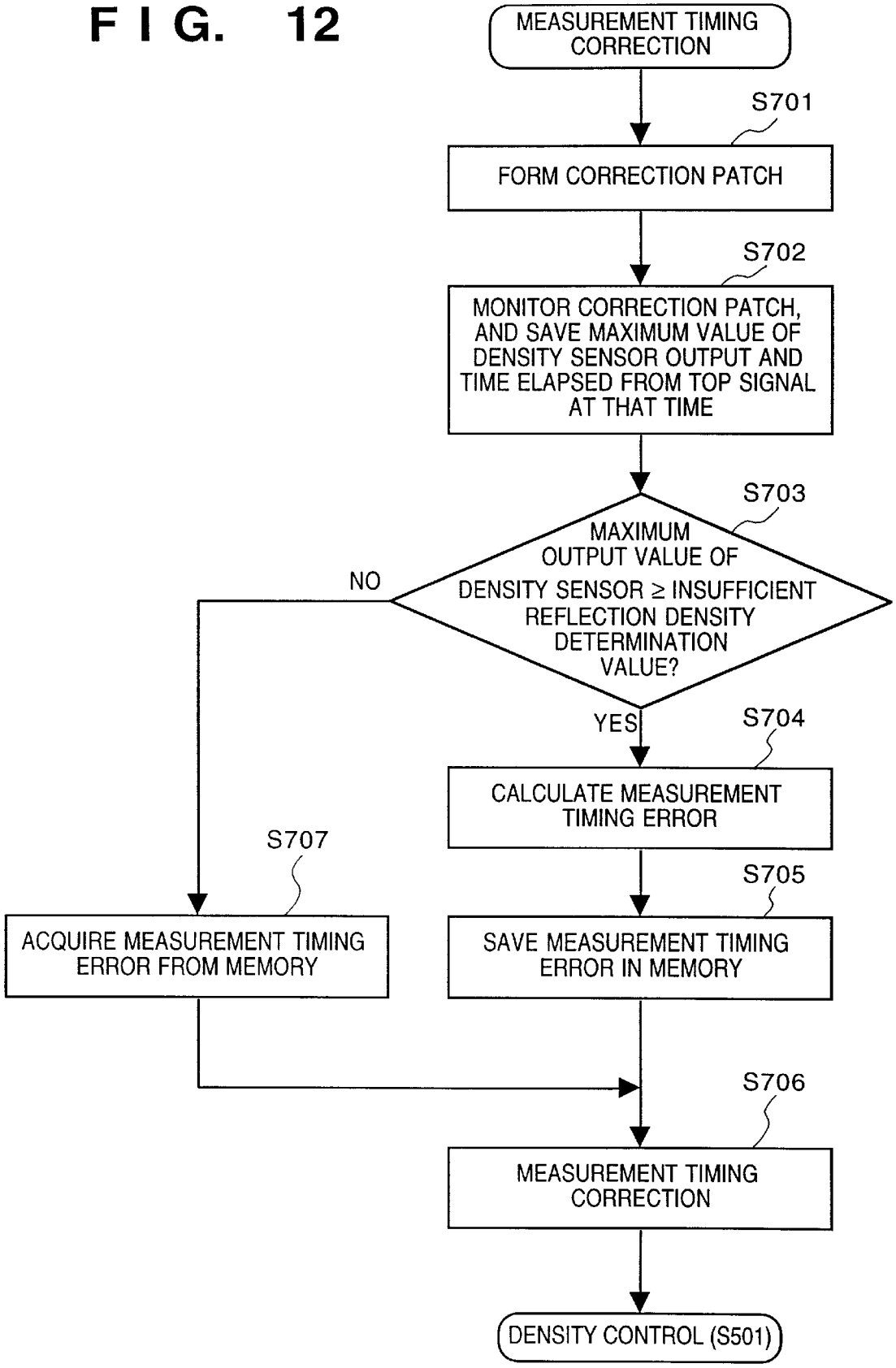
FIG. 12 is a flow chart showing measurement timing correction of density control in the second embodiment.

FIG. 12 is a flow chart showing the density control measurement timing correction in the second embodiment.

A correction patch is formed on the intermediate transfer drum 9 (step S701). A predetermined range including the patch is monitored by the density sensor 9*c*, and the main control CPU 201 saves the maximum output value of the density sensor 9*c* and the time elapsed from the detection timing of the TOP signal by the TOP sensor 9*a* at that time (step S702).

The main control CPU 201 checks if the maximum output value of the density sensor 9*c* has exceeded a predetermined insufficient reflection density determination value within the monitor range (step S703). If the maximum output value has exceeded the insufficient reflection density determination value, the main control CPU 201 determines the peak of the correction patch as its center, and calculates the mechanical precision error based on the time elapsed time from the TOP signal (step S704). The CPU 201 saves the mechanical correction error in the memory 210 (step S705), and then adjusts the background and patch measurement timings of the respective color toner images by the error (step S706). Upon saving the mechanical precision error in step S705, the calculated mechanical precision error itself may be stored, or one, corresponding to the mechanical precision error, of a plurality of levels prepared in advance, may be stored.

On the other hand, if the maximum output value is smaller than the insufficient reflection density determination value (step S703), the CPU 201 ignores the current measurement result of the density sensor 9*c*, and acquires the mechanical precision error already saved in the memory 210 (step S707). After the CPU 201 adjusts the background and patch measurement timings of the respective color toner images based on the error (step S706), it executes the density control shown in FIG. 5.

To recapitulate, according to the second embodiment, even when the correction patch does not have a sufficiently high reflection density, any mechanical precision error produced by vibrations or the like upon rotation of the intermediate transfer drum 9 can be appropriately corrected with reference to the mechanical precision error stored in the memory 210, thus allowing execution of proper density control.

In the first and second embodiments, the reflection densities of the toner image formation region and background region are measured by the density sensor on an identical portion of the surface of the intermediate transfer drum 9. However, the present invention is not limited to such specific example. For example, the present invention can also be applied to density control for a photosensitive drum or the like in a laser printer which forms an electrostatic latent image on the basis of image light formed based on an image signal obtained by scanning an original by an image forming unit, forms a color visible image by multiple-transferring a visible image obtained by developing the electrostatic latent image, and transfers and fixes the color toner image onto a transfer medium.

Each of the above embodiments has exemplified a laser beam printer which uses the intermediate transfer drum 9 as an intermediate transfer body. However, the present invention can be similarly applied to a laser beam printer using an intermediate transfer belt.

To restate, according to the present invention, a correction patch for measurement timing error correction is formed on the surface of the intermediate transfer body before execution of density control, and is monitored by the density sensor, thus detecting the positional deviation between the intermediate transfer body and density sensor resulting from vibrations or the like produced upon rotation of the intermediate transfer body.

Hence, by feeding back the degree of deviation to the measurement timings of the background and toner images formed on the surface of the intermediate transfer body upon density control, the density control precision can be improved.

Furthermore, even when the correction patch is not appropriately formed, since correction is done based on the already acquired mechanical precision error, stable density control is always assured.

<Other Embodiment>

The present invention can be applied to a system constituted by a plurality of devices (e.g., host computer, interface, reader, printer) or to an apparatus comprising a single device (e.g., copy machine, facsimile).

Further, the object of the present invention can be also achieved by providing a storage medium storing program codes for performing the aforesaid processes to a system or an apparatus, reading the program codes with a computer (e.g., CPU, MPU) of the system or apparatus from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (Operating System) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. An image processing apparatus for forming a visible image by developing an electrostatic latent image formed on an image carrier, transferring the visible image onto an intermediate transfer body, and then transferring the visible image onto a recording medium, comprising:

density detection means for forming a first test image for detection position control and a second test image for density control on a surface of said intermediate transfer body, and detecting a reflection density of the first and second test images;

density control means for controlling an image forming condition on the basis of a detection result of said density detection means; and timing control means for controlling a detection timing of said density detection means.

2. The apparatus according to claim 1, wherein said timing control means controls the detection timing of said density detection means on the basis of a detection timing of the first test image by said density detection means.

3. The apparatus according to claim 2, further comprising:

start position detection means for detecting an image formation start position on said intermediate transfer body, and wherein said timing control means controls the detection timing of said density detection means on the basis of a time elapsed from a detection timing of the image formation start position by said start position detection means until said density detection means detects the first test image.

4. The apparatus according to claim 3, wherein said timing control means controls the detection timing of said density detection means on the basis of a difference between the elapsed time and a predetermined value.

5. The apparatus according to claim 3, wherein said timing control means detects a mechanical error in said density detection means on the basis of the elapsed time, and controls the detection timing to correct the mechanical error.

6. The apparatus according to claim 1, wherein the image forming condition is an exposure amount upon forming the electrostatic latent image on said image carrier.

7. The apparatus according to claim 1, wherein the image forming condition is a developing bias voltage upon developing the electrostatic latent image.

8. The apparatus according to claim 1, wherein said density detection means is spaced from said intermediate transfer body.

9. The apparatus according to claim 1, wherein said intermediate transfer body has a drum shape.

10. An image processing apparatus for forming a visible image by developing an electrostatic latent image formed on an image carrier, transferring the visible image onto an intermediate transfer body, and then transferring the visible image onto a recording medium, comprising:

density detection means for detecting a reflection density of a test image on a surface of said intermediate transfer body;

density control means for controlling an image forming condition on the basis of a detection result of said density detection means; and timing control means for controlling a detection timing of sa id density detection means, wherein said density detection means measures the reflection density based on light irradiated onto and reflected by the test image, and a size of the test image in an operation direction of said intermediate transfer body is not more than a diameter of a beam spot irradiated by said density detection means.

11. An image processing apparatus for forming a visible image by developing an electrostatic latent image formed on an image carrier, transferring the visible image onto an intermediate transfer body, and then transferring the visible image onto a recording medium, comprising:

density detection means for forming a test image on said intermediate transfer body and detecting a reflection density of the test image;

density control means for controlling an image forming condition on the basis of a detection result of said density detection means; and timing control means for detecting a positional deviation of the test image by detecting the test image on said intermediate transfer body using said density detection means, and controlling a detection timing of said density detection means in accordance with a degree of the positional deviation, wherein said detection means measures the reflection density based on light irradiated onto and reflected by the test image, and a size of the test image in an operation direction of said intermediate transfer body is not more than a diameter of a beam spot irradiated by said density detection means.

12. The apparatus according to claim 11, wherein said intermediate transfer body has a drum shape.

13. An image processing apparatus for forming a visible image by developing an electrostatic latent image formed on an image carrier, transferring the visible image onto an intermediate transfer body, and then transferring the visible image onto a recording medium, comprising:

density detection means for forming a test image on said intermediate transfer body and detecting a reflection density of the test image;

density control means for controlling an image forming condition on the basis of a detection result of said density detection means;

timing control means for controlling a detection timing of said density detection means; and holding means for holding timing control information in said timing control means, wherein when the reflection density of said intermediate transfer body detected by said density detection means is less than a predetermined value, said timing control means controls the detection timing of said density detection means on the basis of the timing control information held in said holding means.

14. The apparatus according to claim 13, wherein said timing control means detects a mechanical error in said density detection means, and controls the detection timing to correct the mechanical error, and said holding means holds information of the mechanical error.

15. The apparatus according to claim 13, wherein when the reflection density of the test image detected by said density detection means is not less than the predetermined value, said timing control means holds the timing control information in said holding means.

16. The apparatus according to claim 13, wherein said density detection means measures the reflection density based on light irradiated onto and reflected by the test image, and a size of the test image in an operation direction of said intermediate transfer body is not more than a diameter of a beam spot irradiated by said density detection means.

17. The apparatus according to claim 13, wherein the reflection density of the test image depends on a toner amount upon forming the test image on said intermediate transfer body.

18. The apparatus according to claim 13, wherein said intermediate transfer body has a drum shape.

19. An image processing method for an image processing apparatus for forming a visible image by developing an electrostatic latent image formed on an image carrier, transferring the visible image onto an intermediate transfer body, and then transferring the visible image onto a recording medium, comprising:

a first test image forming step of forming a first test image on said intermediate transfer body;

a first density detection step of detecting a reflection density of the first test image by density detection means;

a timing control step of controlling a detection timing of said density detection means on the basis of a detection timing of the first test image in the first density detection step;

a second test image forming step of forming a second test image on said intermediate transfer body;

a second density detection step of detecting a reflection density of the second test image by said density detection means, the detection timing of which has been controlled in the timing control step; and a density control step of controlling an image forming condition on the basis of a detection result in the second density detection step.

20. The method according to claim 19, wherein said density detection means measures the reflection density based on light irradiated onto and reflected by the first and second test images, and a size of the test image in an operation direction of said intermediate transfer body is not more than a diameter of a beam spot irradiated by said density detection means.

21. An image processing method for an image processing apparatus for forming a visible image by developing an electrostatic latent image formed on an image carrier, transferring the visible image onto an intermediate transfer body, and then transferring the visible image onto a recording medium, comprising:

a first test image forming step of forming a first test image on said intermediate transfer body;

a first density detection step of detecting a reflection density of the first test image by density detection means;

a positional deviation detection step of detecting a positional deviation in said density detection means on the basis of a detection timing of the first density of the first test image in the first density detection step;

a timing control step of controlling a detection timing of said density detection means on the basis of a degree of the positional deviation;

a second test image forming step of forming a second test image on said intermediate transfer body;

a second density detection step of detecting a reflection density of the second test image by said density detection means, the detection timing of which has been controlled in the timing control step; and a density control step of controlling an image forming condition on the basis of a detection result in the second density detection step.

22. The method according to claim 21, wherein said density detection means measures the reflection density based on light irradiated onto and reflected by the first and second test images, and a size of the first and second test images in an operation direction of said intermediate transfer body is not more than a diameter of a beam spot irradiated by said density detection means.

23. An image processing method for an image processing apparatus for forming a visible image by developing an electrostatic latent image formed on an image carrier, transferring the visible image onto an intermediate transfer body, and then transferring the visible image onto a recording medium, comprising:

a first test image forming step of forming a first test image on said intermediate transfer body;

a first density detection step of detecting a reflection density of the first test image by density detection means;

a first timing control step of controlling a detection timing of said density detection means on the basis of a detection timing of the first test image in the first density detection step when the reflection density of the first test image detected in the first density detection step is not less than a predetermined value;

a holding step of holding timing control information in the first timing control step in a memory;

a second timing control step of controlling the detection timing in said density detection means on the basis of the timing control information held in said memory when the reflection density of the first test image detected in the first density detection step is less than the predetermined value;

a second test image forming step of forming a second test image on said intermediate transfer body;

a second density detection step of detecting a reflection density of the second test image by said density detection means, the detection timing of which has been controlled in the first or second timing control step; and a density control step of controlling an image forming condition on the basis of a detection result in the second density detection step.

24. The method according to claim 23, wherein said density detection means measures the reflection density based on light irradiated onto and reflected by the first and second test images, and a size of the first and second test images in an operation direction of said intermediate transfer body is not more than a diameter of a beam spot irradiated by said density detection means.

25. A storage medium which stores a program code of an image processing method for an image processing apparatus for forming a visible image by developing an electrostatic latent image formed on an image carrier, transferring the visible image onto an intermediate transfer body, and then transferring the visible image onto a recording medium, said program code having:

a code of a first test image forming step of forming a first test image on said intermediate transfer body;

a code of a first density detection step of detecting a reflection density of the first test image by density detection means;

a code of the timing control step of controlling a detection timing of said density detection means on the basis of a detection timing of the first test image in the first density detection step;

a code of the second test image forming step of forming a second test image on said intermediate transfer body;

a code of a second density detection step of detecting a reflection density of the second test image by said density detection means, the detection timing of which has been controlled in the timing control step; and a code of a density control step of controlling an image forming condition on the basis of a detection result in the second density detection step.

26. A storage medium which stores a program code of an image processing method for an image processing apparatus for forming a visible image by developing an electrostatic latent image formed on an image carrier, transferring the visible image onto an intermediate transfer body, and then transferring the visible image onto a recording medium, said program code having:

a code of a first test image forming step of forming a first test image on said intermediate transfer body;

a code of a first density detection step of detecting a reflection density of the first test image by density detection means;

a code of a positional deviation detection step of detecting a positional deviation in said density detection means on the basis of a detection timing of the first density of the first test image in the first density detection step;

a code of a timing control step of controlling a detection timing of said density detection means on the basis of a degree of the positional deviation;

a code of a second test image forming step of forming a second test image on said intermediate transfer body;

a code of a second density detection step of detecting a reflection density of the second test image by said density detection means, the detection timing of which has been controlled in the timing control step; and a code of a density control step of controlling an image forming condition on the basis of a detection result in the second density detection step.

27. A storage medium which stores a program code of an image processing method for an image processing apparatus for forming a visible image by developing an electrostatic latent image formed on an image carrier, transferring the visible image onto an intermediate transfer body, and then transferring the visible image onto a recording medium, said program code having:

a code of a first test image forming step of forming a first test image on said intermediate transfer body;

a code of a first density detection step of detecting a reflection density of the first test image by density detection means;

a code of a first timing control step of controlling a detection timing of said density detection means on the basis of a detection timing of the first test image in the first density detection step when the reflection density of the first test image detected in the first density detection step is not less than a predetermined value;

a code of a holding step of holding timing control information in the first timing control step in a memory;

a code of a second timing control step of controlling the detection timing in said density detection means on the basis of the timing control information held in said memory when the reflection density of the first test image detected in the first density detection step is less than the predetermined value;

a code of a second test image forming step of forming a second test image on said intermediate transfer body;

a code of a second density detection step of detecting a reflection density of the second test image by said density detection means, a detection timing of which has been controlled in the first or second timing control step; and a code of a density control step of controlling an image forming condition on the basis of a detection result in the second density detection step.

28. An image processing apparatus for forming a visible image by developing an electrostatic latent image formed on an image carrier, transferring the visible image onto an intermediate transfer body, and then transferring the visible image onto a recording medium, comprising:

first test image forming means for forming a first test image on said intermediate transfer body:

first density detection means for detecting a reflection density of the first test image by density detection means;

timing control means for controlling a detection timing of said density detection means on the basis of a detection timing of the first test image in the first density detection means;

second test image forming means for forming a second test image on said intermediate transfer body;

second density detection means for detecting a reflection density of the second test image by said density detection means, the detection timing of which has been controlled in the timing control means; and density control means for controlling an image forming condition on the basis of a detection result in the second density detection means.

29. The apparatus according to claim 28, wherein said density detection means measures the reflection density based on light irradiated onto and reflected by the first and second test images, and a size of the first and second test images in an operation direction of said intermediate transfer body is not more than a diameter of a beam spot irradiated by said density detection means.

30. An image processing apparatus for forming a visible image on an image carrier, transferring the visible image onto an intermediate transfer body, and then transferring the visible image onto a recording medium, comprising:

first test image forming means for forming a first test image on said intermediate transfer body;

first density detection means for detecting a reflection density of the first test image by density detection means;

positional deviation detection means for detecting a positional deviation in said density detection means on the basis of a detection timing of the first density image in the first density detection means;

timing control means for controlling a detection timing of said density detection means on the basis of a degree of the positional deviation;

second test image forming means for forming a second test image on said intermediate transfer body;

second density detection means for detecting a reflection density of the second test image by said density detection means, the detection timing of which has been controlled in the timing control means; and density control means for controlling an image forming condition on the basis of a detection result in the second density detection means.

31. The apparatus according to claim 30, wherein said density detection means measures the reflection density based on light irradiated onto and reflected by the first and second test images, and a size of the first and second test images in an operation direction of said intermediate transfer body is not more than a diameter of a beam spot irradiated by said density detection means.

* * * * *